United States Patent [19]

Curtis, Sr.

[11] Patent Number: 4,510,766

[45] Date of Patent: Apr. 16, 1985

[54] WATER EXCHANGER AND METHOD FOR EVAPORATIVE COOLER

[76] Inventor: Thad C. Curtis, Sr., 5820 S. Hopdown La., Tucson, Ariz. 85746

[21] Appl. No.: 474,840

[22] Filed: Mar. 14, 1983

[51] Int. Cl.[3] ..... F28D 3/00

[52] U.S. Cl. ..... 62/171; 261/DIG. 46; 261/27; 62/310

[58] Field of Search ..... 62/171, 304, 305, 309, 62/311, 310; 261/26, 27, 36 R, DIG. 3, DIG. 46; 236/46 R; 137/132

[56] References Cited

U.S. PATENT DOCUMENTS 2,828,761 4/1958 Weibert ..... 67/171 X 4,333,887 6/1982 Goettl ..... 62/171 X

*Primary Examiner*—Henry Bennett

*Attorney, Agent, or Firm*—Weiss & Holloway

[57] ABSTRACT

Apparatus and method are disclosed for refreshing the water in an evaporative cooler. The apparatus includes a sump in which water for the cooler is collected. The sump is divided into two portions by a dividing dam. A pump supplying water to the cooler is positioned in one portion of the sump; a drain is positioned in the other portion. The drain is normally closed by a ball and flapper assembly and the sump is normally filled to a preselected level higher than the dividing dam. Periodically the ball and flapper are raised to flush the water from the sump so that contaminates and minerals are flushed from the sump and the water can be replaced by fresh water. During the flushing cycle enough water is trapped in the first portion of the sump by the dam so that the pump can continue to operate. In one embodiment the periodic flushing is accomplished by a mechanical flushing timer incorporated with the pump motor.

13 Claims, 3 Drawing Figures

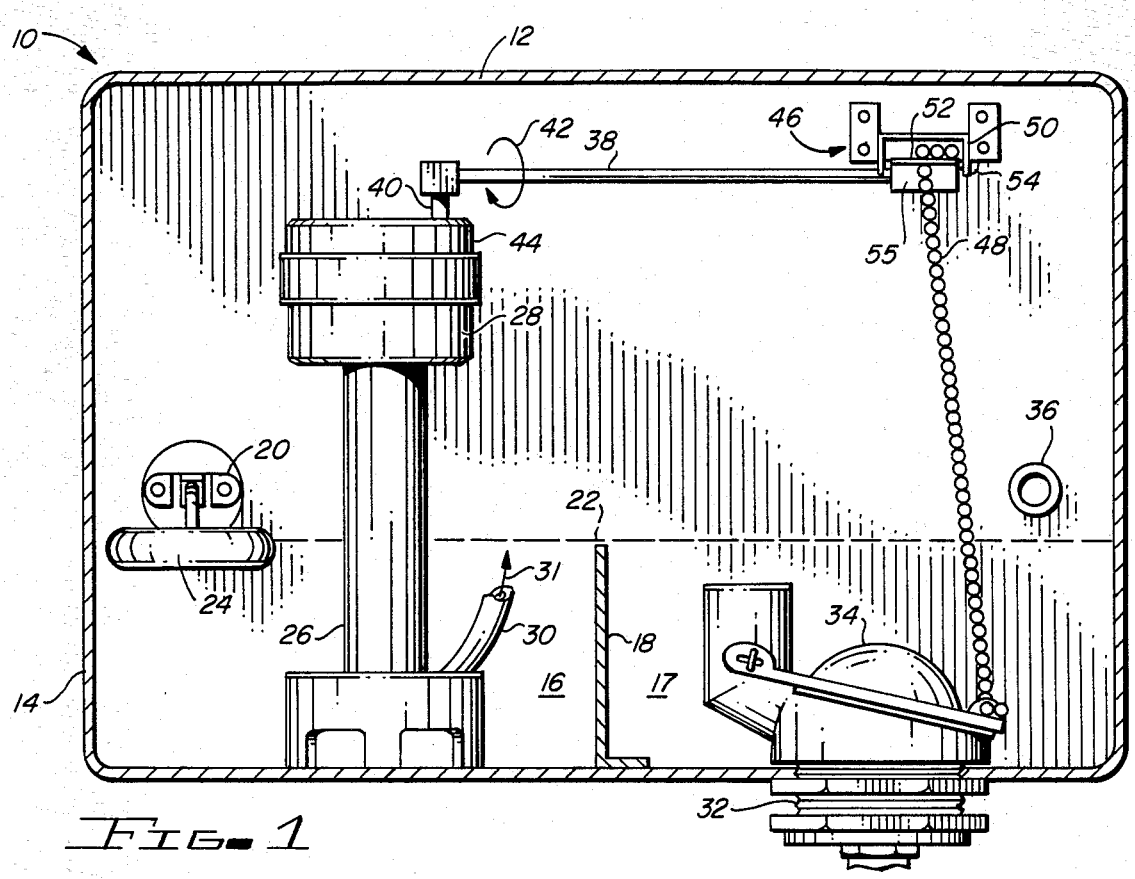
FIG. 1
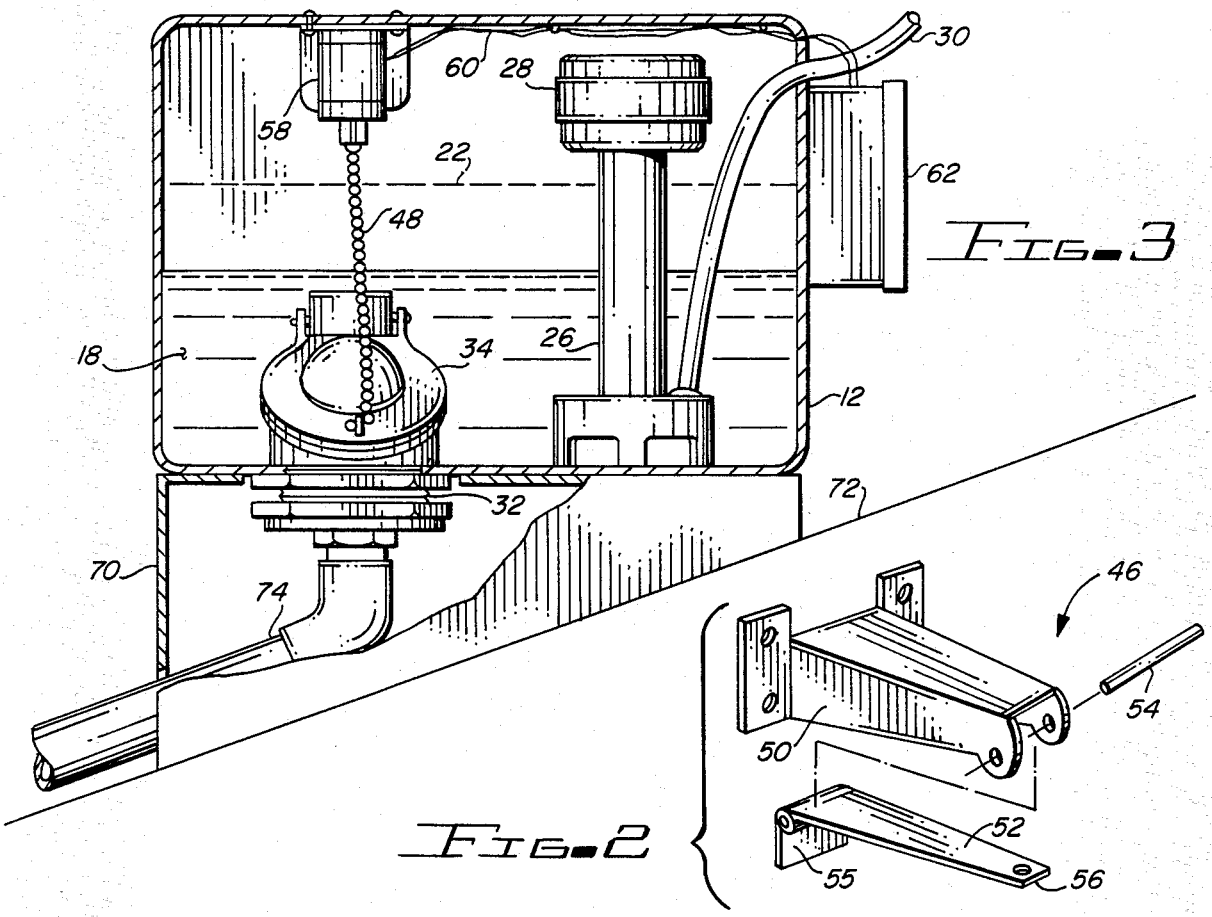
FIG. 3
FIG. 2

WATER EXCHANGER AND METHOD FOR EVAPORATIVE COOLER

BACKGROUND OF THE INVENTION

Field of the Invention

This invention relates generally to evaporative coolers and, more specifically, to apparatus and method for periodically refreshing the water used in an evaporative cooler.

An evaporative cooler is a cooling apparatus which operates by forcing air through pads which are saturated with water; the air is cooled by evaporation of the water from the pads. The conventional cooler includes a sump filled with water from which the water is pumped through tubing known as a spider, to a drip system at the top of the pads. The water drips down through the pads and the excess returns to the sump. Water is added to the sump to replace water lost by evaporation.

Although an evaporative cooler is generally an energy efficient, practical air conditioner, it has shortcomings which reduce its effectiveness and which make it less than totally satisfactory in use. The shortcomings relate to contaminants which collect and build up in the recirculating water. Air passing through the cooler pads carries dirt, algae, bacteria, and the like. Additionally, the water contains minerals which are left behind as the water evaporates. The dirt and minerals deposit on the pads, clog the pads, and reduce the cooling efficiency. Bacteria and algae multiply on the pads and in the sump, causing clogging and loss of efficiency. More importantly, however, the build up of such organic contaminants cause an unpleasant "fishy" odor which is transmitted to the cooled air.

Two methods have previously been proposed to reduce the problem of contamination, but they have not been entirely satisfactory. One method is to continuously bleed off a small amount of the water distributed by the spider. This is partially effective, but does not reduce large scale build ups of contaminants in the sumps. A second method is to add chemicals to the water to kill organic contaminants. The additives are expensive and have no effect on inorganic contaminants such as dirt and minerals. Also, the two methods cannot easily be combined because the chemical additives may be harmful to vegetation. The water bled off, if it contains additives, must therefore be carefully disposed of.

Accordingly, a need existed for means to solve the foregoing problems attendant with evaporative coolers which have not been satisfactorily solved by prior art methods.

It is therefore an object of this invention to provide an improved apparatus for exchanging the water used in an evaporative cooler.

It is a further object of this invention to provide a method for refreshing the water in an evaporative cooler.

It is another object of this invention to provide an improved apparatus for increasing the efficiency of an evaporative cooler.

It is yet another object of this invention to provide an improved method for operating an evaporative cooler.

BRIEF SUMMARY OF THE INVENTION

The foregoing and other objects and advantages of the invention are achieved through the use of an apparatus which periodically refreshes the recirculating water of an evaporative cooler without interrupting the operation of the cooler. The apparatus includes a water-tight tank from which water is pumped to the cooler and within which the water level is controlled. A drain is positioned on the bottom of the tank, and periodically the drain is opened to remove water from the apparatus; the tank is subsequently refilled with fresh water.

BRIEF DESCRIPTION OF THE DRAWINGS

FIG. 1 illustrates, in cut away front view, one embodiment of the invention;

FIG. 2 illustrates, in exploded perspective view, one embodiment of a tripping mechanism as part of a timing apparatus; and FIG. 3 illustrates, in cut away side view, a further embodiment of the invention.

DETAILED DESCRIPTION OF THE DRAWINGS

FIG. 1 illustrates, in a front view, one embodiment of a water exchange apparatus 10 in accordance with the invention. Apparatus 10 includes an enclosure 12 including a water-tight tank or sump 14. The tank is divided into first 16 and second 17 sides by a divider or dam 18.

In the first side of the tank is positioned a fresh water inlet 20 which fills the sump to a water level 22 indicated by the broken line. The water is maintained at this level by a conventional float controlled shut off mechanism 24. Also positioned in first side 16 is a pump 26 driven by pump motor 28 which delivers the water from the sump to an evaporative cooler through a pump outlet 30. Although not illustrated in this Figure, the water exits the pump as indicated by arrow 31 and is conveyed to the cooler and there distributed through a water distribution system generally known as a spider.

Positioned in second side 17 of sump 14 is a drain 32. Drain 32 is normally closed, with the drain closure being effected by drain closing means such as a conventional ball and flapper assembly 34. The ball and flapper assembly can be of the type normally found, for example, in controlling the water level in toilets. Also positioned in the second side is a water return 36 which returns water to the sump from the evaporative cooler.

In accordance with the invention, the drain closing ball and flapper assembly 34 is coupled to a timing apparatus which periodically causes the drain to open. In this embodiment, the timing apparatus includes a rotating rod 38 which rotates on an shaft 40 as indicated by the arrow 42. The shaft 40 is driven by pump motor 28. To provide the appropriate rate of rotation, a gear reduction box 44 may be interposed between the pump motor and shaft 40. Once during each rotation the end of rod 38 trips a tripping mechanism 46 which is attached to the side of enclosure 12. The periodic tripping of mechanism 46 by the end of rod 38 pulls connector 48 which, in turn, lifts ball and flap assembly 34 and opens drain 32. Connector 48 can be a chain, cable, or the like.

The timing mechanism can be set to cycle, and thus cause the drain to open, from 1 to 12 or more times for each 24 hours the cooler is operating. In this embodiment the cycle time is determined by the gear reduction and by the pump motor speed. During each cycle the drain is opened from 10 to about 60 minutes. The length of the drain cycle is determined by the shape and relative positions of the rotating rod and the tripping mechanism. The frequency and duration of cycling are selected consistent with water conditions, water cost, weather, water flow, contaminant sources, and the like.

FIG. 2 illustrates one embodiment of tripping mechanism 46 in further detail. The mechanism includes a mounting bracket 50 which is affixed to the wall of enclosure 12. A tripping lever 52 is pinned to the mounting bracket by a pin 54. The lever is free to rotate about the pin. The lever includes a striking portion 55 which is aligned to be struck by rotating rod 38 on each drain cycle. The striking by the rotating rod causes the mechanism to rotate about pin 54. Raising the end of tongue 56 to which connector 48 is attached. The shape of striking portion 55 and the length and shape of tongue 56 together with the angle between these two portions further determine, along with the rotation speed of rotating rod 38, the length of the drain cycle.

FIG. 3 illustrates a further embodiment of timing a mechanism, in accordance with the invention, for controlling the periodicity and length of the drain cycle. FIG. 3 illustrates the water exchange apparatus 10 in side view. Visible in this view are the pump 26 and motor 28, dividing dam 18, water line 22, drain 32 and ball and flapper assembly 34. The ball and flapper assembly is controlled, through connector 48 by a solenoid mechanism which includes a solenoid 58. The solenoid is powered through cord 60 by an electrical, electronic or mechanical timer 62 which can be mounted on a wall of enclosure 12. The timer operates in a conventional and well known manner to activate the solenoid 58 with the desired cyclic periodicity and for the desired length of time.

FIG. 3 also illustrates one embodiment of installation of the water exchange apparatus 10. The apparatus is mounted on a base 70 having a pitch adapted for the slope of roof 72 on which it is mounted. Pump 26 supplies water through tube 30 to the evaporative cooler mounted nearby. Water returning from the cooler enters sump 14 through tubing 36 (not shown in this cut away section) through the wall of the sump. The return tubing is preferably located on the drain side of the dividing dam 18. Drain line 74 conveys the water expelled through drain 32 to waste or to some useful waste water purpose.

The operation of the water exchange apparatus, in accordance with a preferred embodiment of the invention, is as follows. With reference to the apparatus illustrated in FIG. 1, sump 14 is filled with water to water level 22 through fresh water inlet 20. Both sides 16 and 17 are filled. Pump 26, powered by motor 28 pumps water from the sump, through tubing 30 to the evaporative cooler. The water level in the sump is maintained at water level 22 by float control mechanism 24. As the motor drives the pump, it also drives shaft 40 and, in turn, rotating rod 38 through gear reduction box 44. The rotating rod rotates until it strikes the striking portion 55 of tripping mechanism 46. This causes the mechanism to pivot about shaft 54 raising tongue 52 and pulling on connector 48. Connector 48, in turn, lifts ball and flapper assembly 34 opening drain 32 and allowing water to drain from the sump. The drain remains open until the rod 38 continues its rotation past the tripping mechanism allowing the ball and flapper to drop back into a closed position. During the time the drain is open, enough water is trapped on the pump side of divider 18 to allow the pump to operate normally. As soon as the drain opens, fresh water inlet 20 opens to replenish the supply of water in the sump. Fresh water spills over the dam and out the drain, removing contaminates, minerals and the like from the sump and restoring the purity of the water supplied to the cooler. Return line 36, which returns water from the cooler, is preferably located on the dam side of the sump to help insure that the recirculating water is periodically drained when the drain is open.

Operation of water exchange apparatus with an evaporative cooler results in the cooler pads being flushed often and the water being changed often. This change is adjusted to occur before the concentration of minerals and contaminates has a chance to build up to an excessive value. This prevents or retards the build up of dirt and crusty mineral deposits on the cooler pads and prevents a undesirable build up of bacteria and algae on the pads and in the water which can cause an unpleasant odor. As a result the cooler pads and parts last longer and the cooler operates at a higher efficiency and effectiveness. This, in turn, reduces the amount of time the cooler must be operated and thus reduces the amount of electricity and water that must be used.

It is therefore apparent that there has been provided, in accordance with the invention, an apparatus and method for periodically exchanging the water used by an evaporative cooler that fully meets the objects and advantages set forth above. The invention has been described and illustrated by reference to specific embodiments thereof, but it is not intended that the invention be limited to these illustrative embodiments. Those skilled in the art will appreciate, after review of the foregoing description, that variations and modifications in these embodiments are possible without departing from the spirit and scope of the invention. It will be appreciated, for example, that in areas of especially low water pressure it may be desirable to return the water from the cooler to the pump side of the dividing dam to insure an adequate supply of water to the pump. Accordingly, all such variations and modifications are intended to be included within the scope of the following claims.

What is claimed is:

1. Water exchange apparatus for use with an evaporative cooler which comprises:

a water-tight tank having a bottom, said tank being divided into first and second portions;

means operably secured to said tank for controlling water height within said tank;

pump means operably secured to said tank for pumping water from said first portion of said tank to said evaporative cooler;

water return means operably coupled to said tank for returning water from said evaporative cooler to said tank;

drain means positioned on said bottom of said tank for draining water from said tank;

timing means for periodically actuating said drain means; and damming means operably secured to said tank for dividing said tank into said first and second portions such that said pump means and said means for controlling water height are located in said first portion and said drain means and water return are located in said second portion.

2. Apparatus for periodically renewing the water in an evaporative cooler which comprises:

a water tank for mounting near said evaporative cooler, said tank having a bottom;

a dam affixed to said bottom and extending upwardly therefrom, said dam dividing said tank into first and second portions;

pump means positioned in said first portion for pumping water from said first portion to said evaporative cooler;

a motor for driving said pump;

an opening through said bottom positioned in said second portion;

a ball and flap assembly for closing said opening;

a rotatable shaft coupled to said motor;

a trip mechanism mounted to said tank and positioned to be tripped by said shaft as said shaft rotates;

a connection between said trip mechanism and said ball and flap assembly to cause said assembly to lift and open said opening to allow water to drain from said tank;

water inlet means for replenishing water in said tank, said water inlet means being positioned in said first portion;

water level control means coupled to said water inlet means; and water return means operably coupled to said tank for returning water from said evaporative cooler to said tank, said water return means being positioned in said second portion.

3. Apparatus for exchanging water in an evaporative cooler which comprises:

a sump;

a divider separating said sump into first and second portions;

pump means driven by a motor in said first portion for pumping water from said first portion to said cooler;

a water outlet positioned in said second portion for draining said second portion of said sump;

a water inlet for supplying water to said sump, said water inlet being positioned in said first portion;

water level control means for controlling the level of water in said sump, said water level adjusted to a height above the height of said divider;

water return means operably coupled to said sump for returning water from said cooler to said sump, said water return means being positioned in said second portion;

water outlet closing means coupled to said water outlet for opening and closing said outlet; and timing means for periodically opening said water outlet closing means.

4. A method for exchanging the water in an evaporative cooler which comprises the steps of:

providing a sump divided by a divider into first and second portions;

providing water outlet means in said second portion;

providing water to said sump from water inlet means located in said first portion;

filling said sump to a preselected level higher than said divider;

pumping water from said first portion of said sump to said evaporative cooler by a pump located in said first portion;

periodically opening said water outlet means to flush water from said second portion of said sump, said divider maintaining water in said first portion to allow said pump to continue operating during the periodic opening;

periodically returning water from said cooler to said second portion of said sump to be flushed from said sump during periodic opening of said water outlet means; and refilling said sump to said preselected level following each said periodic opening.

5. The apparatus of claim 1 wherein said drain means comprises:

water outlet means; and ball and flap means for temporarily sealing said outlet means.

6. The apparatus of claim 1 wherein said timing means comprises:

gear reduction means coupled to said pump means;

rotating means coupled to said gear reduction means and capable of rotating with a periodic interval; and coupling means capable of being periodically engaged between said rotating means and said drain means.

7. The apparatus of claim 6 wherein said rotating means comprises a rotating shaft.

8. The apparatus of claim 7 wherein said coupling means comprises trip means mounted to said tank and positioned to be tripped by said rotating shaft; and a chain coupled between said trip means and said drain means.

9. The apparatus of claim 1 wherein said timing means comprises:

a timer;

a solenoid means coupled to said timer;

means coupled between said solenoid means and said drain means for opening said drain means when said solenoid means is activated by said timer.

10. The apparatus of claim 3 wherein said timing means comprises a rotatable shaft driven from said motor;

trip means positioned to be tripped once during each rotation of said shaft; and connecting means positioned between said trip means and said water outlet closing means.

11. The apparatus of claim 3 wherein said timing means comprises:

a timer;

a solenoid activated in response to said timer; and connecting means between said solenoid and said water outlet closing means.

12. The apparatus of claim 8 wherein said means for controlling water height comprises water inlet means for supplying water to said tank and water level control means for controlling the level of water in said tank, said water level being adjusted to a height above the height of said damming means.

13. The apparatus of claim 9 wherein said means for controlling water height comprises water inlet means for supplying water to said tank and water level control means for controlling the level of water in said tank, said water level being adjusted to a height above the height of said damming means.

* * * * *